United States Patent [19]

Galicia

[11] 3,946,877

[45] Mar. 30, 1976

[54] CLIP-TYPE HOLDER FOR TOOTHBRUSHES OR THE LIKE

[76] Inventor: Virgil René Galicia, P.O. Box 147, Great Neck, N.Y. 11022

[22] Filed: Nov. 12, 1974

[21] Appl. No.: 523,053

[52] U.S. Cl. ..... 211/65; 211/89; 248/205 A

[51] Int. Cl.[2] ..... A47F 5/08

[58] Field of Search ..... 211/89, 65, 63, 66, 60 R; 248/205 A, 104, 108, 109, 111, 113, 74 A; 24/81 CC, 257, DIG. 11

[56] References Cited

UNITED STATES PATENTS

| | | | |
|---|---|---|---|
| 1,555,960 | 10/1925 | Fuller | 24/DIG. 11 |
| 2,466,195 | 4/1949 | Anderson et al. | 211/89 |
| 2,470,811 | 5/1949 | Engleman | 248/74 A |
| 2,591,041 | 4/1952 | Berg | 211/89 |
| 3,524,215 | 8/1970 | Kurtz | 248/205 |
| 3,659,319 | 5/1972 | Erickson | 248/74 A |

FOREIGN PATENTS OR APPLICATIONS

| | | | |
|---|---|---|---|
| 707,857 | 1/1962 | Canada | 248/74 A |

*Primary Examiner*—Roy D. Frazier
*Assistant Examiner*—Robert A. Hafer

[57] ABSTRACT

A multiclip plastic holder for toothbrushes, razors and other like articles has a base strip coated with a pressure-sensitive adhesive on its back side permitting the strip to be applied securely to any clean, firm surface whether flat or round. Integral with the base strip at spaced intervals therealong is a plurality of sets of coacting clip fingers each with outwardly-flared tips and suitably larger spacing midway therebetween to permit the handle of a toothbrush to be pressed therebetween from the outer end and to grip the handle and hold the same releasably in place. Each set of clip fingers is integral with the base strip over a sufficiently narrow length thereof to retain a flexibility for even adhesive application of the base strip to uneven surfaces without affecting the grip of the coacting clip fingers. In an alternative embodiment, the base strip has also clip members at the ends receiving cores to which a protective liner for the pressure-sensitive coating is attached. One of these cores is enlarged to serve as a spool which when pulled from one clip can be rolled along the back side of the base member to wind up the liner and to be then snapped into the second clip at the other end. When the holder is detached from a wall and is to be packed with other belongings for a later use, the spool is pulled from the second clip, rolled along the back side of the base strip to reapply the protective liner and is then snapped back into the first clip.

3 Claims, 6 Drawing Figures

FIG. 1
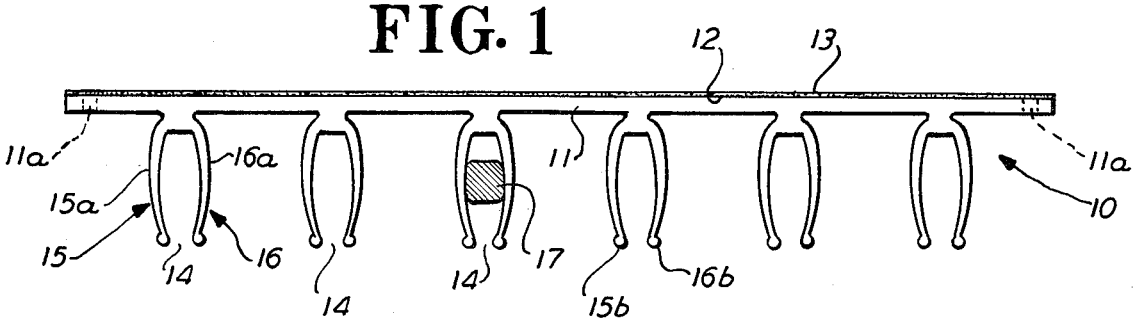
FIG. 2
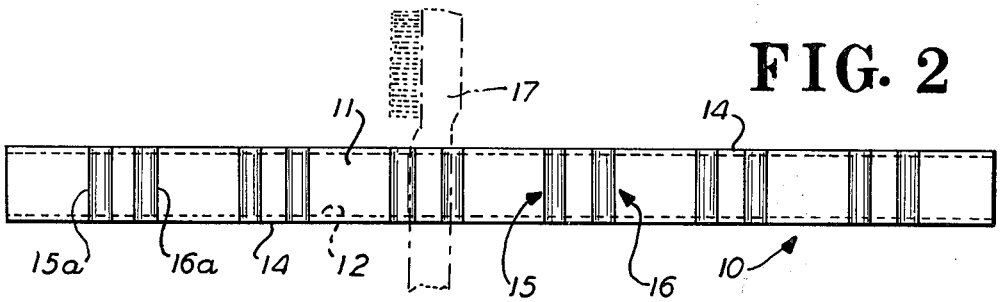
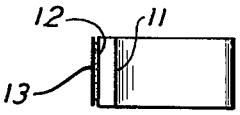
FIG. 3
FIG. 4
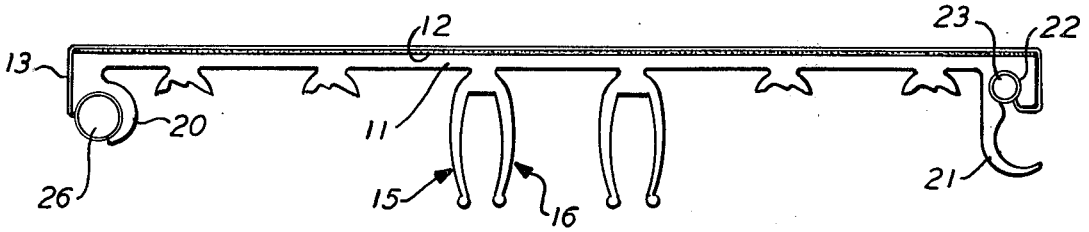
FIG. 5
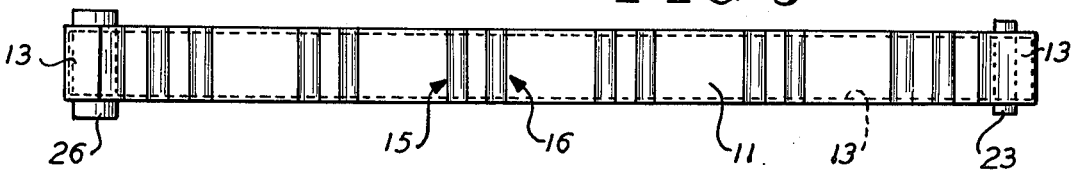
FIG. 6
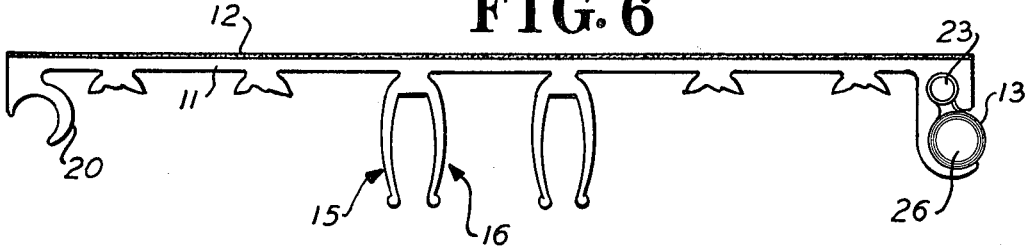

CLIP-TYPE HOLDER FOR TOOTHBRUSHES OR THE LIKE

An object of the invention is to provide improved plastic holders of the character described which are of a very economical design adapted for permanent or temporary use in any one location and which can be reused as desired.

Another object of the invention is to provide an improved plastic holder suitable especially for traveling persons — i.e., tourists, salesmen, etc. — which can be easily applied releasably to a wall in one's room to hold various utilities in a sanitary way during one's stay, and which can be then detached, stored and reused on any later trip.

Another object is to provide such holder having a flexible base strip provided with a series of sets of coacting clip fingers on its front side and a pressure-sensitive coating on its back side permitting it to be applied with a strong grip to any flat or curved supporting surfaces without reducing the grip by which the clip fingers can hold the handles of various utilities.

Another object is to provide such holder having a flexible base which can be applied evenly to existing flat and/or round bathroom fixtures and which has gripping fingers to hold the handle of a toothbrush without slippage so as to support the toothbrush hygienically without contact of the bristles with any surface or object.

Another object is to provide such plastic holder with a protective liner over the pressure-sensitive coating, which can be readily rolled up and retained to the holder while the holder is gripped adhesively to a wall surface, and which can then be easily reapplied over the pressure-sensitive surface to protect it for reapplication later to a wall surface while maintaining the pressure-sensitive coating clean without loss of grip.

These and other objects and features of the invention will be apparent from the following description and the appended claims.

In the description of my invention reference is had to the accompanying drawings, of which:

FIG. 1 is a top plan view of a first embodiment of the present plastic holder;

FIGS. 2 and 3 are front and side elevational views of this holder;

FIG. 4 is a top plan view of a second embodiment adapted especially for reuse and wherein the protective liner is shown in place;

FIG. 5 is a front elevational view of this second embodiment; and

FIG. 6 is another top plan view of this second embodiment showing the protective liner removed and wound on a spool clipped to the far end of the holder.

The present plastic holder 10 for toothbrushes and the like is of a one-piece molded construction comprising a base strip 11 typically ½ inch wide and about 7 inches long, made of a plastic having a suitable rigidity and spring character such as polystyrene. The base strip has a pressure-sensitive adhesive coating 12 on its back side along the length thereof of a type which will have a strong grip to a wall surface. This coating is covered by a releasable protective liner 13 which is removed when the holder is to be applied to a wall surface. Holes 11*a* in the base strip permit the holder to be secured further by screws (not shown) to a wall when a permanent mounting is desired. Formed on the front side of the base strip is a series of sets 14 of coacting spring fingers 15 and 16 having outwardly-bowed central portions 15*a* and 16*a* and outer ends 15*b* and 16*b* flared apart to permit a rounded handle 17 as of a toothbrush or razor to be pressed sidewise while in upright position between a pair of clip fingers, camming the fingers first apart and becoming then engaged by clamping pressure of the fingers as the handle enters a center position between the clip members.

In order that the clip fingers of each set will have a strong clamping grip, the fingers are made progressively thicker in cross section proceeding from the outside towards the base portion 18 thereof. However, this base portion is secured integrally to the base strip 11 over only a narrow portion of the width thereof so that the flexibility of the base strip 11 is not impaired and so that bending of the base strip will not affect the grip of the respective sets of clip fingers. Also, this design permits the handle to be pulled out without loosening the adhesive grip of the base strip to the wall.

In order that the protective liner 13 can be easily preserved and held in place for an easy and immediate reapplication over the pressure-sensitive coating 12 when the holder has been peeled from a supporting wall and is to be packed until it is to be used again, the holder is provided with a wide-open clip 20 at its left end and with a similar but slightly larger clip 21 at its right end, of which the latter has also an inner smaller clip 22. A small rod 23 which has an end of the liner cemented thereto or looped therearound is pressed into the inner clip 22 whereby to secure the liner to the holder. The liner leads from the rod 23 across the inner rounded wall portion of the larger clip 21 and around the end of the holder lengthwise of the base strip in overlying relation to the pressure-sensitive coating. The liner is then led around the left end of the base strip to a larger rod or spool 26 to which the liner is secured as by cementing. This spool is pressed releasably into the clip 20.

When the holder is to be mounted on a wall surface, the user grips the ends of the spool 26 which extend beyond the sides of the holder and draws the spool from the clip 20, whereupon he rolls the spool along the back side of the base strip to peel off the liner and wind it on the spool. Thereupon, he presses the spool with the liner wound thereon into the clip 21. When the holder is removed from a supporting wall to be packed away for another later use, he withdraws the spool from the clip 21 and rolls it back across the base strip to reapply the liner over the coating in protective relation thereto and then snaps the spool back into the clip 20 until the holder is to be reused.

The embodiments of my invention herein particularly shown and described are intended to be illustrative and not necessarily limitative of my invention since the same is subject to changes and modifications without departure from the scope of my invention, which I endeavor to express according to the following claims.

I claim:

1. A molded one-piece plastic holder for toothbrushes and the like comprising a flexible base strip having a pressure-sensitive adhesive coating on its back side for releasably holding the base strip by adhesive grip to a supporting wall, a plurality of sets of coacting clip fingers on the forward side of said base strip formed integrally therewith, the clip fingers of each set having narrow, outwardly-flared tips enabling a handle of a toothbrush when held at right angles to said fingers to be pressed therebetween, and having outwardly-bowed central portions for gripping said handle with a clamping pressure and holding the same releasably therebetween each set of clip fingers terminating at a common base wherein the common base of each set of clip fingers is joined through a section narrower than said common base to said base strip so that the base strip has a uniform flexibility for even adhesive application to both flat and rounded wall surfaces and so that the grip of the respective sets of clip fingers is not affected when the base strip is applied to a rounded wall surface.

2. A molded one-piece plastic holder for toothbrushes and the like comprising a flexible base strip having a pressure-sensitive adhesive coating on its back side for releasably holding the base strip by adhesive grip to a supporting wall, a plurality of sets of coacting clip fingers on the forward side of said base strip formed integrally therewith, the clip fingers of each set having narrow, outwardly-flared tips enabling a handle of a toothbrush when held at right angles to said fingers to be pressed therebetween, and having outwardly-bowed central portions for gripping said handle with a clamping pressure and holding the same releasably therebetween, wherein said adhesive coating is protected by a flexible releasable liner when the holder is not in use, including means on said holder for removably retaining said liner thereto after its removal from said adhesive coating for reapplication over said adhesive coating after the holder is stripped from a wall surface, said liner being permanently secured to one end of said holder.

3. A molded one-piece plastic holder for toothbrushes and the like comprising a flexible base strip having a pressure-sensitive adhesive coating on its back side for releasably holding the base strip by adhesive grip to a supporting wall, a plurality of sets of coacting clip fingers on the forward side of said base strip formed integrally therewith, the clip fingers of each set having narrow, outwardly-flared tips enabling a handle of a toothbrush when held at right angles to said fingers to be pressed therebetween, and having outwardly-bowed central portions for gripping said handle with a clamping pressure and holding the same releasably therebetween, wherein said adhesive coating is protected by a flexible releasable liner when the holder is not in use, including means on said holder for removably retaining said liner thereto after its removal from said adhesive coating for reapplication over said adhesive coating after the holder is stripped from a wall surface, wherein said liner-retaining means comprises a spool to which one end of said liner is secured, a clip at one end of said base strip for releasably holding said spool when said liner applied to said adhesive coating, and a clip at the other end of said base strip for releasably holding said spool with said liner wound thereon after the spool has been detached from said first clip and rolled along the back side of said base strip to peel the liner from said adhesive coating.

* * * * *